US007194842B2

(12) United States Patent
Baird

(10) Patent No.: US 7,194,842 B2
(45) Date of Patent: Mar. 27, 2007

(54) PORTABLE OBSERVATION TOWER

(76) Inventor: Jeffery D. Baird, P.O. Box 2227, Ada, OK (US) 74821

( * ) Notice: Subject to any disclaimer, the term of this patent is extended or adjusted under 35 U.S.C. 154(b) by 636 days.

(21) Appl. No.: 10/696,524

(22) Filed: Oct. 29, 2003

(65) Prior Publication Data

US 2005/0091941 A1 May 5, 2005

(51) Int. Cl.
*E04H 12/34* (2006.01)

(52) U.S. Cl. ..... 52/125.2; 182/127; 187/240; 187/242; 187/243; 187/261

(58) Field of Classification Search ..... 52/124.1, 52/124.2, 125.2, 125.3, 114, 118, 735.1, 111, 52/116, 121, 123.1; 182/127, 63.1; 187/240, 187/242, 243
See application file for complete search history.

(56) References Cited

U.S. PATENT DOCUMENTS 294,860 A * 3/1884 Dye ..... 182/51
470,112 A * 3/1892 Ehrentraut ..... 182/18
693,877 A * 2/1902 MacRae ..... 52/109
1,718,979 A * 7/1929 Protzeller ..... 182/62.5
RE28,455 E * 7/1975 Denier et al. ..... 182/16
5,927,440 A * 7/1999 Freeman ..... 187/270
6,405,831 B1 * 6/2002 Daniel, III ..... 182/127
6,523,641 B2 * 2/2003 Smith ..... 182/63.1
2002/0139613 A1 * 10/2002 Hardy et al. ..... 182/63.1
2003/0000769 A1 * 1/2003 Pyle ..... 182/63.1

* cited by examiner

*Primary Examiner*—Jeanette Chapman
*Assistant Examiner*—Jessica Laux
(74) *Attorney, Agent, or Firm*—Jackson Walker, LLP

(57) ABSTRACT

A portable structure from which hunters and wildlife observers can command elevated views of wildlife habitat. Commonly called a blind, it can be constructed as a stand-alone structure and transported intact to habitat sites on, for example a flat-bed truck. It can also be constructed as a trailer, or as a permanent or semi-permanent attachment to a motorized vehicle. The blind offers powered erection, powered access to and from the observation position, and wheelchair accessibility.

9 Claims, 3 Drawing Sheets

PORTABLE OBSERVATION TOWER

FIELD OF THE INVENTION

The present invention pertains to the field of portable structures for use in the field by hunters and wildlife observers.

BACKGROUND OF THE INVENTION

Hunters want elevated enclosed structures, typically called "blinds," from which to command broad views of hunting grounds. They currently rely on permanent structures that are built on-site or that are built off-site and transported to a hunting ground, manually set upright, and then anchored for stability with lines or cables. Relocation of such structures without proper equipment and personnel can be difficult and dangerous.

There are many hunters who do not own land suitable for hunting. Many of those hunters lease hunting property, and may not lease the same property from year to year. Many hunters also prefer certain leases for certain game, and may move from one lease to another depending on the hunting season. Also, a hunter may sometimes discover that he has constructed his blind in a less than ideal location. For such hunters, permanent blinds can be prohibitively expensive. Also, landowners may not want multiple blinds or permanent structures left on their property when hunters move to other locations.

Some hunters are precluded from using blinds because of physical disabilities. Access to conventional blinds is typically by means of a ladder. A hunter is required to climb up the ladder carrying his weapons, ammunition, and any supplies he might need during the hunt. Wheelchair users are generally unable to use elevated blinds.

The same limitations apply to anyone with a need to temporarily maintain an elevated position. Wildlife observers such as birdwatchers, wildlife photographers, scientists, and moviemakers, among others, are hindered in their pursuits by the necessity for erecting permanent or semi-permanent structures.

SUMMARY OF THE INVENTION

The present invention alleviates the specified problems associated with hunting blinds and elevated observation towers. Mobile hunting blinds can be deployed on a lease, left for all or part of a season, and then moved to another location without being completely dismantled and reconstructed. Mobile blinds can easily be moved among several locations on the same lease if hunting conditions or game habits change. The winch-controlled personnel enclosure offers convenient access to portable observation towers. The addition of ramps makes towers wheelchair-accessible.

DETAILED DESCRIPTION OF THE PREFERRED EMBODIMENT

Figure 1:
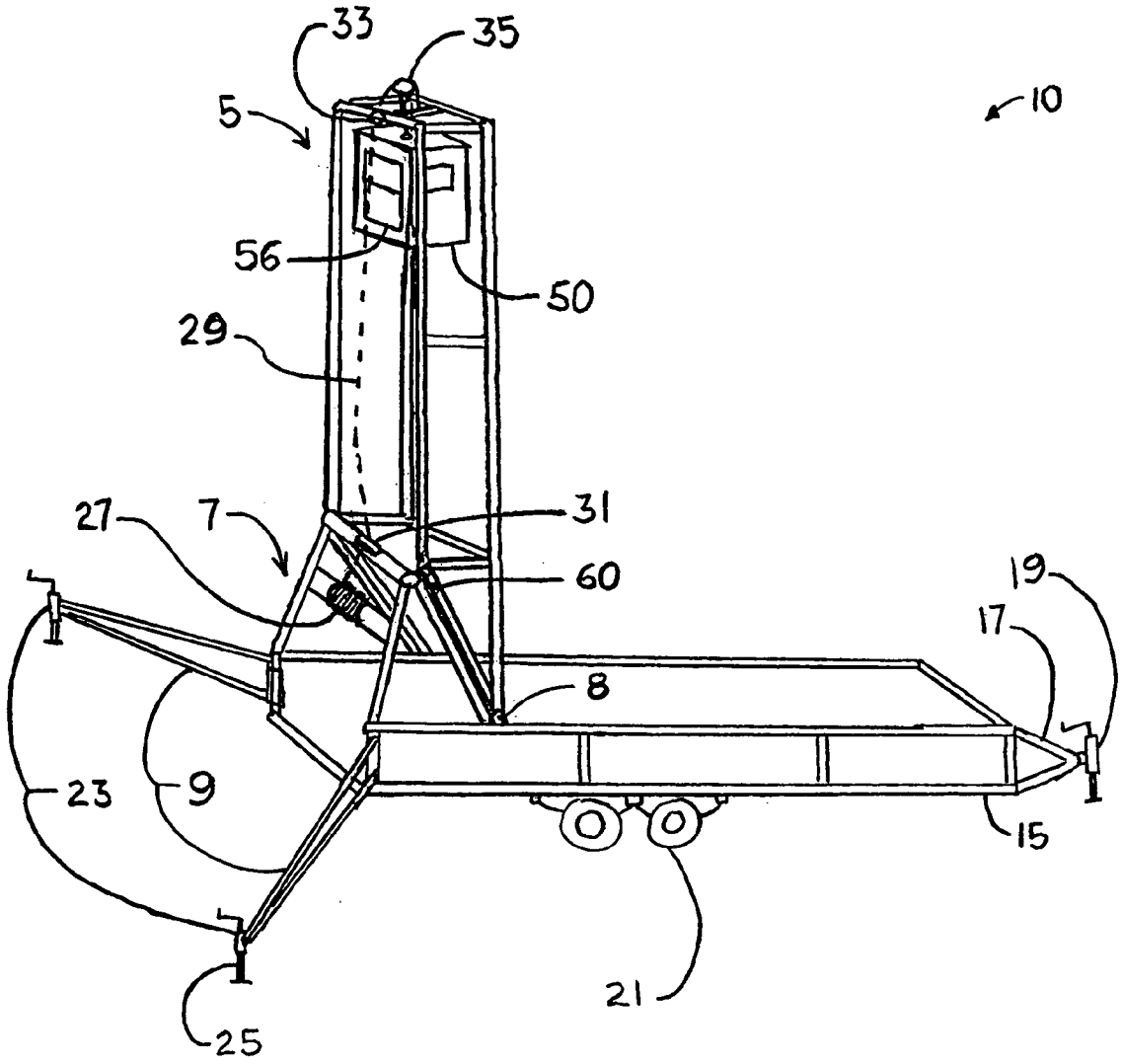
FIG. 1 is an isometric view of a first embodiment of the present invention with the tower section elevated and secured, the structure stabilized with two outriggers and a trailer tongue jack, and the personnel enclosure deployed in the uppermost position from which hunters would have a good view of a hunting ground.
Figure 3:
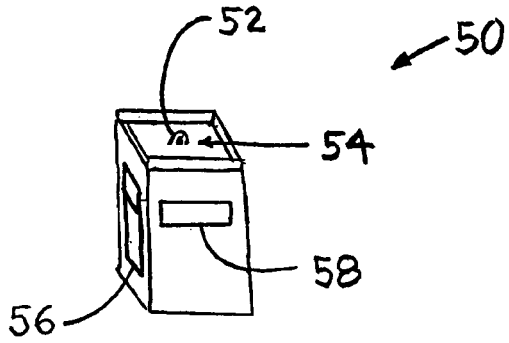
FIG. 3 is an isometric view of one embodiment of the personnel enclosure with a personnel access door, a window, and an eyebolt for receiving a shackle and cable by which the enclosure can be raised and lowered on the observation tower.
Figure 2:
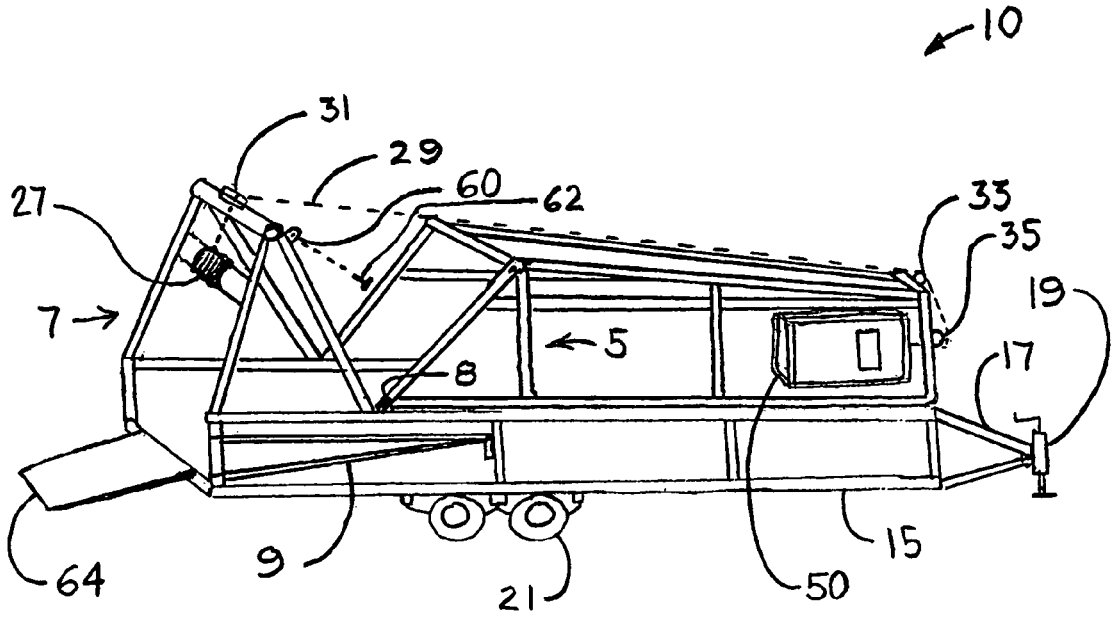
FIG. 2 is an isometric view of the first embodiment, but with the tower section and outriggers secured for storage or transport.

A first embodiment 10 of the invention is shown in FIGS. 1–3. As shown in FIGS. 1 and 2, a tower section 5, a tower support section 7 having generally an A-frame shape, and two pivotable outrigger members 9 are attached to a frame 15 having a tongue section 17, a front jack assembly 19, and an axle assembly 21. Tower section 5, tower support section 7, and frame 15 may be constructed from materials such as high strength steel or aluminum tubes or channel.

The tower section 5 is attached to the frame 15 by means of two hinges or pivots 8 on opposite sides of the frame. FIG. 1 shows leveling jack assemblies 23 attached to the outriggers 9 that are in positions pivotally extended from the frame 15 for providing stability to the hunting blind 10. FIG. 1 shows leveling jack members 25 extended from leveling jack assemblies 23 for cooperation with the front jack assembly 19 in securely balancing the blind 10 upon the ground.

FIG. 2 shows an outrigger 9 pivotally retracted to a position substantially proximate to the frame 15 when it is desirable to configure the blind 10 in its first transport and storage position. In the first transport and storage configuration, the tower section 5 is supported in a substantially horizontal position by the frame 15, and the cable 29 is tensioned by the winch 27 so that the personnel carrier 50 is snugged against the top (as considered with the tower in its vertical position) of the tower section 5. For transport and storage, the winch should be locked against rotation, the outriggers 9 secured to the frame 15 in their inboard positions, a ramp 64 should be stowed securely, and the tower section and personnel carrier securely attached to the frame 15 with tie-down means familiar in the industry of equipment and vehicle transport.

FIGS. 1 and 2 show cable 29, run through sheaves 31, 33, and 35 from winch 27, and releaseably connected, as with a cable eye and shackle means (not shown), to a pad eye 52 on the top surface 54 of a personnel enclosure 50 (see FIG. 3). The personnel enclosure as shown has a personnel access door 56 and a window 58. The door is framed such that it will accommodate a wheelchair.

In the disclosed embodiment, an electric winch 27, by means of tensioning the cable 29, raises the tower section 5 about pivots 8 from its first storage and transport position depicted in FIG. 2 to its second upright and deployed position supported against support section 7 as depicted in FIG. 1. Pad eye 60 and pin 62 serve as a locking means to releaseably affix the tower section 5 to the tower support section 7 when the tower section 5 has been raised to the substantially vertical position. Pin 62 may be a bolt that is secured with a nut, or a drilled pin that is secured with a cotter pin or a quick-release linchpin commonly used in farm and ranch implements.

When the tower section 5 is locked in the vertical, deployed position with locking means 60 and 62, a rigid integral structure is formed, comprising support section 7, tower section 5, and frame 15. The integral structure is stabilized with outriggers 9, leveling jack assemblies 23, and front jack assembly 19.

The winch 27 and cable 29 serve as a means for transporting personnel, equipment, and supplies between ground level and the top of the tower section inside and on the personnel enclosure 50. The winch motor may be controlled from within the personnel enclosure by means of a remote control device such as those commonly used to control garage door openers or other motorized equipment. Alternatively, electrical control of the winch may be hard-wired from the personnel enclosure. FIG. 2 shows a ramp 64 that may be deployed for easy access to the personnel enclosure 50 when it is in its lowest position at the bottom of the tower.

Figure 4:
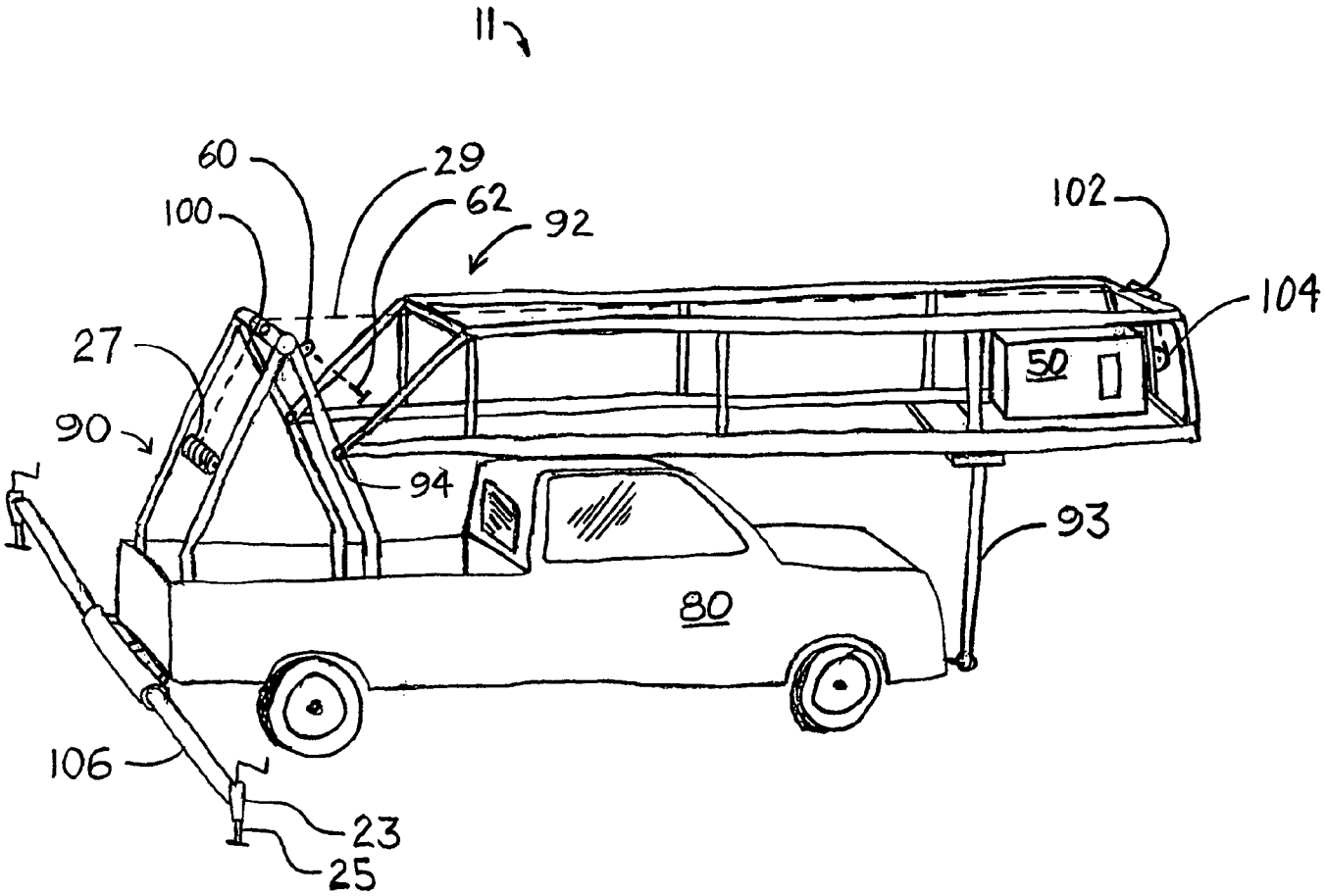
FIG. 4 is an isometric view of a second embodiment of the present invention mounted on a truck. Telescoping outriggers are shown deployed at the rear of the truck, and the tower and personnel enclosure are shown in a position ready for deployment to the upright position.

FIG. 4 illustrates a second embodiment 11 of Applicant's invention mounted on a motorized vehicle 80. A base tower support section 90 may be removeably mounted on a section of the motorized vehicle. A tower section 92 is attached to the base tower support section 90 by means of two hinges or pins 94 on opposite sides of the tower support section. The tower section 92 is partially supported and secured for transit by a tower support post 93 pivotally and removeably attached to the motorized vehicle 80.

In FIG. 4, cable 29 is run through sheaves 100, 102, and 104 from winch 27, and releaseably connected, as with a cable eye and shackle means (not shown), to a pad eye 52 on the top surface 54 of a personnel enclosure 50, shown in FIG. 3. In the FIG. 4 embodiment, an electric winch 27, by means of tensioning the cable 29, raises the tower section 92 from its storage and transport position depicted in FIG. 4 to an upright, deployed position similar to that depicted in FIG. 1. Pad eye 60 and pin 62 serve as a locking means to releaseably affix the tower section 92 to the base tower support section 90 when the tower section 92 has been raised to the deployed, substantially vertical position.

FIG. 4 shows a telescoping outrigger 106 removeably attached to the motorized vehicle 80. The outrigger has at least one leveling jack assembly 23 and leveling jack member 25 that extends to provide a means for contacting the ground and stabilizing the blind 11.

When locked in the vertical position with locking means 60 and 62, and stabilized with an outrigger 106 and leveling jack assemblies 23, the winch 27 and cable 29 serve as a means for transporting personnel, equipment, and supplies between ground level and the top of the tower section inside and on the personnel enclosure 50. The winch motor may be controlled from within the personnel enclosure by means of a remote control device commonly used to control garage door openers or other motorized equipment. Alternatively, electrical control of the winch may be hard-wired from the personnel enclosure. A ramp 64, as shown in FIG. 2, may be deployed for easy access to the personnel enclosure 50 when it is in its lowest position at the bottom of the deployed tower section 92 and the base tower support section 90.

While the present invention has been described in terms of two preferred embodiments, it will be apparent to those skilled in the art that form and detail modifications may be made to those embodiments without departing from the spirit or scope of the invention. For example, it should be understood that a roof and the perimeter wall or walls of Applicant's personnel enclosure could be permanently affixed to the top of the tower section, and that the moveable portion of Applicant's personnel enclosure could comprise a floor and a safety cage.

I claim:

1. A portable observation tower comprising:

a frame;

a tower support section attached to a rear section of the frame;

a tower section pivotally attached to the frame;

a personnel enclosure having a personnel opening and volume at least sufficient to contain one adult person, the personnel enclosure being moveably attached to the tower section;

a winch located on the tower support section;

a winch cable having a first end attached to a drum of the winch and a second end removeably attached to the personnel enclosure;

a means for using the winch and cable to raise the tower section and personnel enclosure from a first position substantially parallel to and resting on the frame to a second position substantially vertical;

a means for locking the tower section into the second position; and a means for using the winch and cable to move the personnel enclosure up and down the tower section between a first position substantially near the top of the tower section to a second position substantially near the bottom of the tower section.

2. The apparatus of claim 1 wherein the tower section is pivotally attached to the tower support section.

3. The apparatus of claim 1 wherein the winch is located on the frame.

4. The apparatus of claim 2 wherein the winch is located on the frame.

5. An apparatus as in any one of the preceding claims in which the frame has a tongue section, one or more axles, and at least two wheels.

6. The apparatus of claim 5 further comprising:

an outrigger member having an inboard end and an outboard end, the inboard end being pivotally attached to the frame; and a leveling jack attached substantially near the outboard end of the outrigger member, the leveling jack having a means for providing contact with the ground by a leveling jack member.

7. The apparatus of claim 5 further comprising a ramp suitable for wheelchair access and moveably attached to the frame, the ramp having a first end proximate to the frame and a second end proximate to the ground when the ramp is in a position extended from the frame.

8. The apparatus of claim 5 further comprising a ramp suitable for wheelchair access and moveably attached to the tower support section, the ramp having a first end proximate to the tower support section and a second end proximate to the ground when the ramp is in a position extended from the tower support section.

9. An apparatus as in any one of claims 1–4 in which the frame is removeably mountably mountable to a motorized vehicle.

* * * * *